US005247418A

United States Patent [19]

Auge

[11] Patent Number: 5,247,418

[45] Date of Patent: Sep. 21, 1993

[54] ARC SUPPRESSING SWITCH

[76] Inventor: George C. Auge, 22911 La More, Perris, Calif. 92370

[21] Appl. No.: 665,120

[22] Filed: Mar. 6, 1991

[51] Int. Cl.[5] ..... H01H 9/30

[52] U.S. Cl. ..... 361/10; 361/205; 200/144 R; 335/201

[58] Field of Search ..... 361/2, 10, 13, 102, 361/114, 205, 189, 190; 200/144 R; 335/201

[56] References Cited

U.S. PATENT DOCUMENTS

| | | | |
|---|---|---|---|
| 1,310,269 | 7/1919 | Wright | 335/201 |
| 1,843,615 | 9/1928 | Lyle | 361/2 |
| 2,040,405 | 4/1935 | Persons | 361/2 |
| 3,689,808 | 9/1972 | Stampfli | 317/155 |
| 4,367,448 | 1/1983 | Nishizako | 335/201 |
| 4,802,051 | 1/1989 | Kim | 361/2 |

*Primary Examiner*—Steven L. Stephan
*Assistant Examiner*—Adolf Berhane
*Attorney, Agent, or Firm*—Sheldon & Mak

[57] ABSTRACT

An arc suppressing switch having a plurality of discrete conductors operative to allow a flow of electricity between a pair of terminals along each of the plurality of discrete conductors when the switch is closed. The conductors are oriented to distribute the total current flowing through the switch among the discrete conductors; and so that the current in each of the discrete conductors is substantially simultaneously interrupted when the switch is opened to prevent the production of an arc across the gap created at the break. The switch preferably has an intermediate contact layer containing the plurality of discrete conductors positioned between internal contact plates so that when the switch is closed a first side of the intermediate layer contacts one of the contact plates and a second side of the intermediate layer contacts the other contact plate to allow a flow of electricity between the pair of contact plates along each of the plurality of discrete conductors. In the preferred embodiment, the conductors are bundled together for efficient production and use.

20 Claims, 3 Drawing Sheets

ARC SUPPRESSING SWITCH

FIELD OF THE INVENTION

The present invention relates to an electronic switch and, more particularly, to a switch adapted to prevent the formation of an electric arc upon activation or deactivation.

BACKGROUND OF THE INVENTION

Industrial facilities, such as manufacturing and assembly plants, typically require large electrical currents for facility operations. In fact, a single large facility may require an electrical power supply capable of producing an alternating electric current of over a million amps. Large diameter conductors are required to safely handle the flow of such electrical currents without damage.

Typical switches are designed to open and close one or more electric circuits by means of guided separable contacts. However, the large electric current associated with the industrial facilities is conductive to the formation of an electric arc between the contacts upon activation and/or deactivation of the switch. An arc can form across the narrow gaps created as the contacts move together or apart. This arc may produce a dangerous explosion or fireball which is potentially damaging to equipment or facilities and/or injurious to people.

Various remedies have been proposed in the past to minimize such arcing, but these remedies have not proved satisfactory in preventing potentially harmful electric arcs. It has been proposed to immerse the moveable contacts in oil to alter the environment where the arc would be created. Other attempts have proposed directing a blast of air at the contacts as they separate. Arc chutes afford a confined space or passageway, typically lined with arc-resistant material, into or through which an arc is directed to extinction. Finally, conventional multiple throw, multiple pole switches may divide the current between a limited number of current paths.

Therefore, there is a need in the industry to provide an improved switch which is capable of handling a large amount of current without creating a dangerous electric arc upon activation or deactivation.

SUMMARY OF THE INVENTION

The present invention provides an arc suppressing switch which has a plurality of discrete conductors. This configuration allows a flow of electricity between a pair of terminals through each of the plurality of discrete conductors when the switch is closed. The discrete conductors are so oriented to permit the switch to substantially simultaneously interrupt the flow of electricity through each of the plurality of conductors. This arrangement distributes the total current flowing through the switch among the discrete conductors. This arrangement prevents the production of a dangerous arc across a gap created as the circuit is made or broken, in as much as the current through any single discrete conductor does not have sufficient amperage to effectively span the gap and produce a dangerous arc.

In an alternative embodiment, the contact plates are also formed of a plurality of insulated wire elements oriented in one or more bundles corresponding to the bundles of the intermediate layer. This arrangement provides a multi-conductor path which may be interrupted at an intermediate point.

According to an important feature of the invention, the present invention provides an arc suppressing switch having an intermediate contact layer having a plurality of discrete conductors disposed between two internal contact plates when the switch is closed A first side of the intermediate layer contacts one of the contact plates and a second side of the intermediate layer contacts the other contact plate to allow a flow of electricity between the pair of contact plates along each of the plurality of discrete conductors. This arrangement distributes the total current flowing through the switch among the discrete conductors of the intermediate layer and prevents the production of a dangerous arc upon separating the contact plates because the current between any single discrete conductor end and a respective contact plate surface is prohibitively small.

According to another important feature of the present invention, the plurality of discrete conductors are formed from a plurality of insulated wire elements oriented parallel to one another. The wire elements are positioned to extend between the first and second sides of the intermediate contact layer. This arrangement provides an simple and efficient method to provide for a plurality of discrete conductors through the intermediate layer so as to provide a contact path between both contact plates.

The plurality of insulated wire elements are oriented into one or more bundles. The bundles have uniform planar opposed end surfaces positioned on the first and second sides of the intermediate contact layer in a manner allowing the end surfaces to contact respective portions of the contact plates. This arrangement allows each of a large number of discrete conductors to function as a path to conduct electricity between the contact plates while conveniently providing the large number of conductors in the switch.

The pair of internal contact plates are adapted for movement relative one another and each contact plate includes an electromagnet section. The electromagnet sections are energized so that the polarity of the electromagnet section on one contact plate is opposite in polarity to the electromagnet section of the other contact plate. In this manner, simultaneously energizing the electromagnet sections of both contact plates causes the pair of contact plates to move toward one another. Thus, the contact plates respectively contact the first and second sides of the intermediate contact layer and are held there by the magnetic attraction between the contact plates allowing a flow of electricity between the pair of contact plates through each of the plurality of discrete conductors of the intermediate contact layer. This arrangement provides an efficient means to close, and hold closed, the switch by using electromagnetic sections which attract the contact plates toward one another.

The intermediate contact layer also includes an electromagnet section. This electromagnet section is energized so that a first portion disposed on the first side of the intermediate layer has the same polarity as the polarity of the contact plate proximate the first side and a second portion disposed on the second side of the intermediate layer has a polarity opposite the polarity of the first portion and the same polarity of the contact plate proximate the second side. In this manner, energizing the electromagnetic section of the intermediate layer at the same time as the electromagnetic sections of the contact plates are energized causes the pair of contact plates to be repelled and simultaneously move apart from one another. The flow of electricity between the pair of contact plates through each of the plurality of discrete conductors of the intermediate contact layer is thereby substantially simultaneously interrupted. This arrangement provides an simple and efficient method to open the switch by using the electromagnetic properties of all the contact surfaces.

BRIEF DESCRIPTION OF THE DRAWINGS

These and other objects and aspects of the invention will become apparent in the detailed description of the invention hereinafter with respect to the drawings in which.

DETAILED DESCRIPTION OF THE PREFERRED EMBODIMENT

The present invention provides an arc suppressing switch which divides an electric current among a plurality of discrete electrical conductors so that minimal current flows through any single discrete conductor to prevent the formation of an electric arc upon activation or deactivation of the switch.

Figure 2:
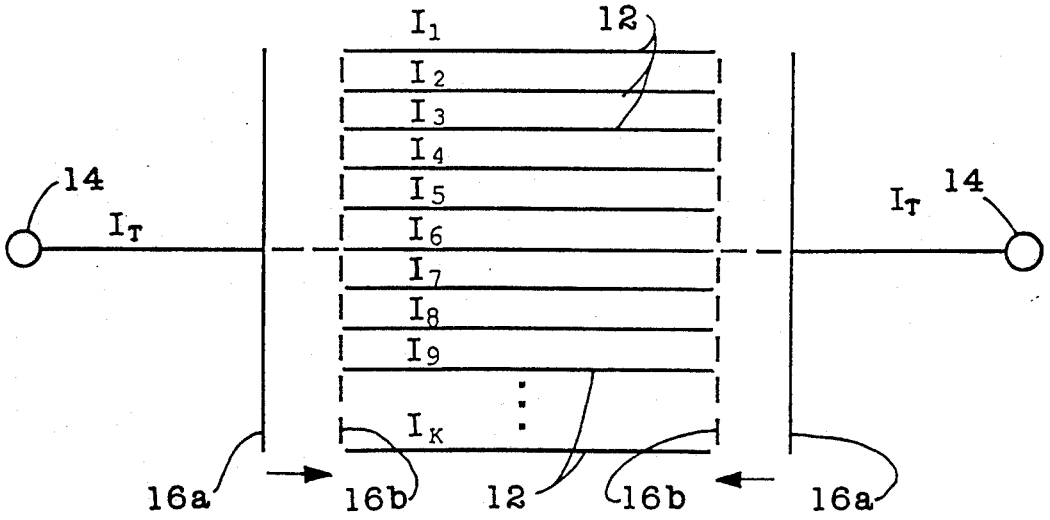
FIG. 2 is a simplified diagram of a multi-path conductor of the present invention.

With reference to FIG. 2, in the most basic form, the present invention provides a switch 10 which utilizes a pair of contact plates 16 which are adapted to move between an open position 16*a* and a closed position 16*b* (shown in dotted lines). When the contact plates 16 occupy closed position 16*b*, they contact opposite ends of a plurality of mutually insulated discrete conductors 12 of similar negligibly low resistance to distribute the total current ($I_T$) between terminals 14 therethrough. Each discrete conductor 12, therefore, has a partial current ($I_K$) therethrough. A large plurality of discrete conductors 12 are utilized to sufficiently minimize the partial current ($I_K$) therethrough. The switch operates to open the circuit by moving the contact plates 16 away from the discrete conductors 12 so as to break the current path in proximity to the plurality of discrete conductors 12 The current path may be interrupted at an end (as shown) of the discrete conductors 12, or alternatively, at an intermediate point (not shown). Regardless of where the path is interrupted, the current between any two points on opposite sides of the break is a minimal partial current ($I_K$) which is minimal due to the plurality of discrete conductors 12. The relatively small partial currents ($I_K$) are not of sufficient size to form a dangerous electric arc.

For example, a total current ($I_T$) of 100,000 amperes can be distributed among 100,000 discrete conductors, so that the current ($I_K$) associated with any single conductor is only 1 ampere. In this manner, a large total current is divided into a large number of small partial currents which can be interrupted without giving rise to electric arcs.

Figure 1:
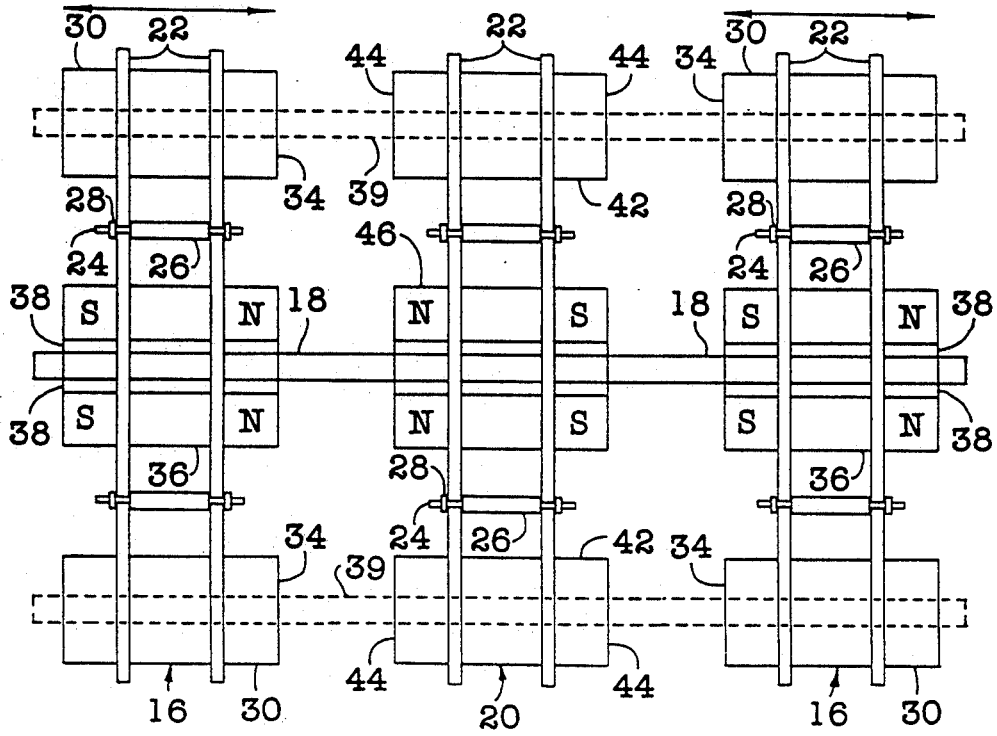
FIG. 1 is a cross sectional view of an electromagnetic switch utilizing the present invention.
Figure 3:
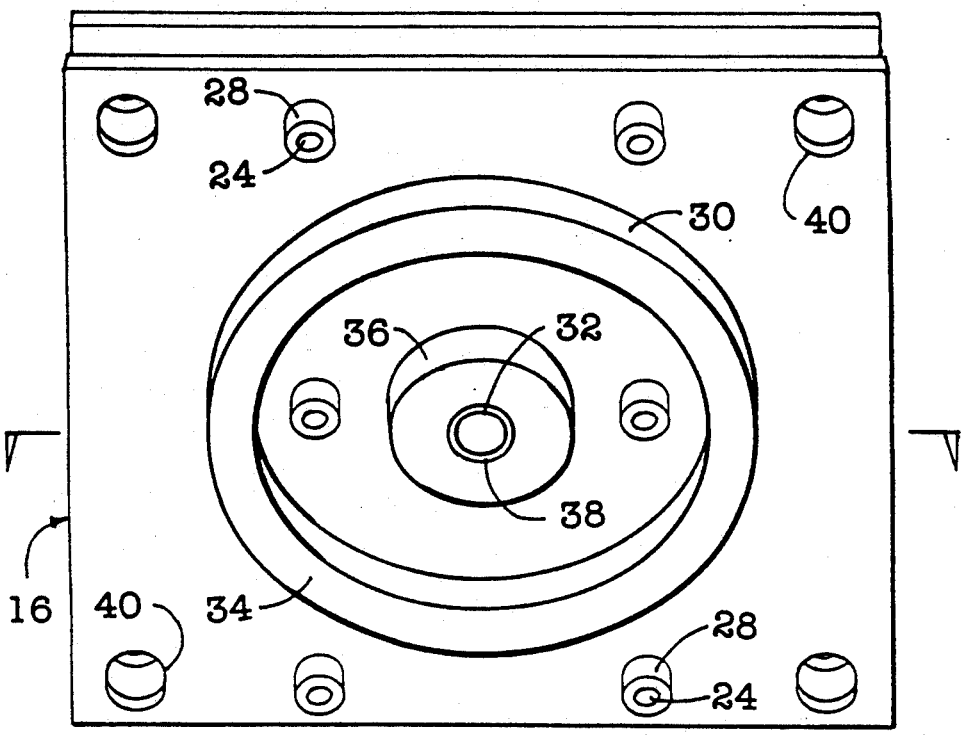
FIG. 3 is a perspective view of a contact plate utilized in the electromagnetic switch of FIG. 1.
Figure 4:
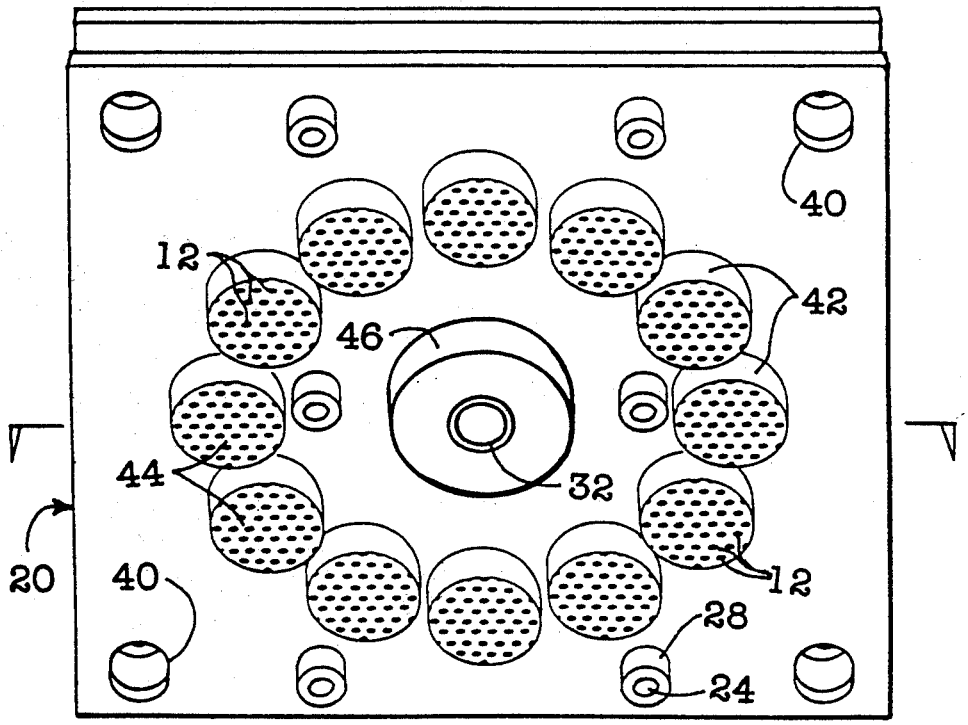
FIG. 4 is a perspective view of an intermediate multi-path conductor plate utilized in the electromagnetic switch of FIG. 1.

With reference also to FIGS. 1, 3 and 4, the preferred embodiment of the present invention utilizes a pair of contact plates 16 slidably disposed substantially parallel to one another on a slide shaft 18 within a housing (not shown for clarity). Each contact plate 16 is electrically connected to a respective externally engageable terminal 14. An intermediate contact plate 20 is fixedly or stationarily disposed on the slide shaft 18 between the contact plates 16 and operates to provide an intermediate multi-path conductor layer formed from a plurality of mutually insulated, similarly low resistance, discrete conductors 12.

More specifically, each contact plate comprises a pair of phenolic boards 22 secured parallel to one another by suitable fastener means, such as bolts 24, spacers 26, nuts 28 or the like. A contact ring 30, centered about the central opening 32 for the shaft 18, extends around one planar face of each contact plate 16 so as to provide a planar contact surface 34 on the side of each contact plate 16 facing the intermediate plate 20 so that the planar contact surfaces 34 of each contact plate 16 are directed toward one another. The contact ring 30 can be formed from any suitable conductive material such as brass, copper or silver. The contact ring 30 of each contact plate 16 is further electrically connected (not shown) to a respective externally engageable terminal 14.

Electromagnet sections 36 are centrally positioned on each contact plate 16 such that the portion of the electromagnet sections 36 on the sides having the planar contact surfaces 34 are of opposite polarity. The contact plates 16 are slidably disposed on the shaft 18 using suitable bearing surfaces 38 such as machined slides and ball bearings, etc. The electromagnetic sections 36 on both contact plates 16 are energized in a manner to produce opposite magnetic fields which attract one another and cause the contact plates 16 to slide along the shaft 18 toward one another so that the planar contact surfaces 34 converge.

Additional alignment shafts 39 (shown in phantom) and related bearings surfaces (not shown) may be positioned through holes 40 to maintain proper parallel orientation between the contact plates 16 as the contact plates 16 slide along shaft 18. These additional alignment shafts 39 prevent the contact plates 16 from canting and producing a current path through a small portion of the intermediate contact plate 20 which would produce a large partial current. The gap between the phenolic boards 22 of each contact plate 16 effectively widens the plates 16 to facilitate this alignment.

The intermediate contact plate 20 is also formed from a pair of phenolic boards 22 suitably secured parallel to one another. A plurality of multi-path conductor bundles 42 are disposed about the intermediate plate so as to extend from one side of the intermediate plate 20 through the boards 22 to the other side. Each bundle 42 is formed from a plurality of individually insulated #14 magnetic wire elements 12 secured parallel to one another in an epoxy adhesive resin. The ends of each bundle 42 are machined to provide a planar contact surface 44 having a plurality of mutually insulated conductive points corresponding to ends of each of the individual wire elements 12. A substantial length of plural wire elements may be secured in this manner and cut into sections to facilitate the production of a large number of bundles. Each bundle 42 is positioned a distance from the central opening 32 so that the ends 44 can contact respective planar contact surfaces 34 of the contact plates 16.

An intermediate electromagnet section 46 is centrally positioned on the intermediate plate 20. The intermediate electromagnet section 46 is adapted to be energized such that the polarity of the portion proximate each side is the same as the polarity of the electromagnet sections 36 of each contact plate 16 proximate thereto. Thus, activation of the intermediate electromagnet section 46 in conjunction with the other electromagnet sections 36 repels the fields associated with the contact plates 16 and causes the contact plates 16 to slide along the shaft 18 apart from one another interrupting the current path through the multi-path conductor layer.

In an alternative embodiment, the planar contact surfaces 34 of the contact plates 16 can be formed from a plurality of bundles 42 of individual conductors, like the intermediate plate 20 shown in FIG. 4. These bundles would be positioned to correspond in placement to the bundles 40 of the intermediate layer, and would allow the multi-conductor path to be interrupted at an intermediate point (B-B in FIG. 2).

Figure 5:
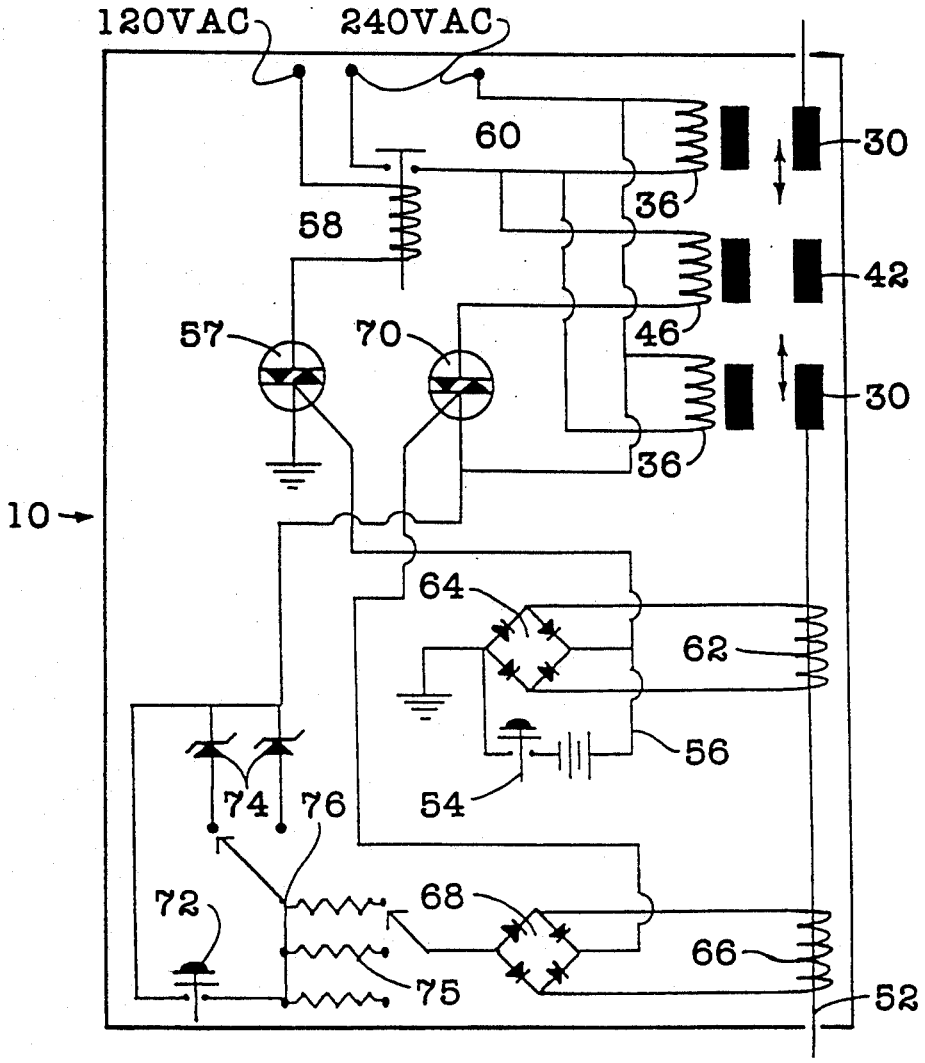
FIG. 5 is a detailed wiring diagram of the switch used on each phase of the electromagnetic switch of FIG. 1.
Figure 6:
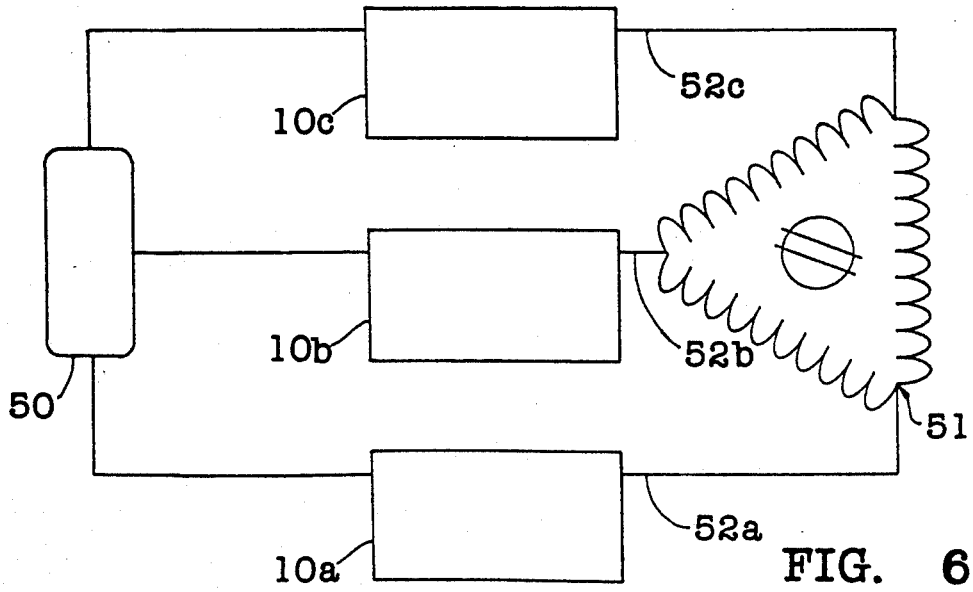
FIG. 6 is a block wiring diagram of the 3 phase circuitry of the electromagnetic switch of FIG. 1.

With reference now also to FIGS. 5 and 6, the preferred embodiment electronically activates the electromagnet sections 46, 36 of the intermediate plate 20 and/or contact plates 16 to open and close the switch respectively. The large current is typically produced by a 3-phase generator 50 connected to the electric load 51 through lines 52*a*, 52*b*, 52*c*. Each phase line 52*a*, 52*b*, 52*c* is controlled by one of three identical switches 10*a*, 10*b*, 10*c* which are ganged together so as to be activated and deactivated together.

Each electronic switch 10 utilizes a manual first switch 54 connected in a 1 to 3 volt dc circuit 56 which causes a first triac 57 to latch on (or conduct) energizing an electromagnetic coil 58 and a second switch 60. The second switch 60, activated by operation of the dc circuit 56, is actuated by the operation of switch 54 and energizes the electromagnet sections 36 on contact plates 16 to produce continuity in line 52 through the contact rings 30 and intermediate bundles 42. Pickup coil 62 powers the bridge diode circuit 64 to keep the first triac 57 latched on (or conducting) and to insure that electromagnet sections 36 remain energized. A second pickup coil 66 powers bridge diode circuit 68 to latch off a second triac 70 via the zener diode 74 selected by switch 76 to ensure that intermediate electromagnet section 46 remains deenergized until-specifically required to open the main circuit.

The switch of the disclosed embodiment may be opened by one of two means. A current selector switch 76 operates to establish an automatic means for opening the switch. A maximum current can be established through load 51, so that if the current in line 52 exceeds a predetermined amount the switch opens. This is accomplished by selecting the appropriate value resister 75 and zener diode 74 in current selector switch 76 such that the zener diode 74 conducts when the maximum current selected is exceeded. This switches on the second triac 70 to energize the intermediate electromagnet section 46. In this manner, the contact rings 30 are separated by "like-pole" repulsion of electromagnet sections 46, 36 and the continuity of line 52 is broken. Further, the pickup coils 62, 66 are no longer powered and all the sub-circuits of the switch 10 are deactivated. To manually open the switch, a manual third switch 72 operates to shunt the zener diodes 74 in the current selector switch 76 and switches on the second triac 70 to energize the intermediate electromagnet section 46.

As stated previously, the switches 10*a*, 10*b*, 10*c* are ganged together so as to simultaneously activate or deactivate. This means the manual first switch 54 and manual third switch 72 of each line switch 10*a*, 10*b*, 10*c* are ganged together for simultaneous operations.

From the foregoing description of the preferred embodiment it can be seen that various alternative embodiments of the invention can be anticipated without departure from the scope of the invention as defined in the following claims.

I now claim:

1. An arc suppressing switch comprising:

(a) a pair of internal contact plates operative between closed and open positions relative to one another to allow current in the closed position of a magnitude sufficient to produce a harmful arc to flow between a respective pair of terminals when the switch is opened and operative to prevent current flow between the terminals in the open position;

(b) an intermediate contact layer having a plurality of discrete individually insulated conductors disposed between the internal contact plates for forming a parallel circuit of the insulated conductors in the closed position, a first side of said intermediate layer contacting one of the contact plates and a second side of said intermediate layer contacting the other of said contact plates, the plurality of discrete conductors being sufficient in number to allow for a flow of electricity between the pair of contact plates through each of the plurality of discrete conductors of a magnitude insufficient to produce a harmful arc when the switch is opened, the flow of electricity through each of the plurality of conductors being substantially simultaneously interrupted when the switch is opened;

(c) an electromagnet section associated with each of said pair of internal contact plates, the electromagnet sections being operative for producing a magnetic polarity in the electromagnetic section of one contact plate and an opposite magnetic polarity in the electromagnet section of the other contact plate, whereby energizing the electromagnet sections of both contact plates at the same time causes the pair of contact plates to move toward one another to the closed position;

(d) an intermediate electromagnet associated with the intermediate contact layer, the intermediate electromagnet being operative to be energized for producing opposite magnetic polarities on opposite sides of the intermediate contact layer, the respective polarities being like the corresponding polarities of the electromagnet section associated with the internal contact plates, whereby energizing the intermediate electromagnet at the same time that the electromagnet sections of said contact plates are energized causes the pair of contact plates to move apart from one another toward the open position to interrupt the flow of electricity between the pair of contact plates through the plurality of discrete conductors of the intermediate contact layer; and (e) an electric circuit operative to simultaneously energize the electromagnet sections of both contact plates having:

(i) a dc subcircuit;

(ii) a first solid state switch connected between said dc subcircuit and a first ac power source so as to be latched on by activation of said subcircuit;

(iii) relay switch means for activating the electromagnet sections of the contact plates when the solid state switch conduits;

(iv) a sensor element disposed for activation by the flow of electricity through said contact plates; and (v) a sensor circuit disposed between the sensor element and the first solid state switch so that the first solid state switch is latched open in response to activation of the sensor element.

2. The switch of claim 1, wherein said electric circuit further includes:

a second solid state switch connected to said intermediate electromagnet section, a second sensor element disposed for activation by the flow of electricity through said contact plates;

a second sensor circuit disposed between said second solid state switch and said second sensor element so that said second solid state switch is latched off by the current in said sensor element; and a manual switch electrically connected between said second sensor circuit and said second solid state switch operative upon closing to provide a current to said second solid state switch so as to latch on said second solid state switch and energize said intermediate electromagnet section.

3. The switch of claim 2, wherein said electric circuit further includes threshold circuit means electrically connected between said second sensor circuit and said second solid state switch so as to latch on said second solid state switch and energize said intermediate electromagnet section when the current through said contact plates exceeds a predetermined current.

4. The switch of claim 1, wherein said plurality of discrete conductors comprise a plurality of mutually insulated, similarly low resistance, wire elements oriented parallel to one another and extending between said first and second sides of said intermediate contact layer.

5. The switch of claim 4, wherein said plurality of insulated wire elements are oriented into a bundle having uniform planar opposed end surfaces positioned on said first and second sides of said intermediate contact layer so that each end surface may contact a respective one of the pair of contact plates.

6. The switch of claim 4, wherein said plurality of insulated wire elements are oriented into a plurality of bundles, each bundle having uniform planar opposed end surfaces positioned on said first and second sides of said intermediate contact layer respectively to contact the pair of contact plates.

7. The switch of claim 1, wherein the first solid state switch comprises a first triac.

8. The switch of claim 1, wherein the relay switch means comprises an electromagnetic switch.

9. The switch of claim 1, wherein the sensor element comprises a pickup coil and the sensor circuit comprises a bridge diode.

10. The switch of claim 3, wherein the threshold circuit means comprises a zener diode and a resistor.

11. An arc suppressing switch which allows current of a magnitude sufficient to produce a harmful arc to flow between a pair of externally engageable terminals, comprising:

(a) a pair of internal contact plates disposed substantially parallel to one another within the switch, each of said contact plates being electrically connected to a respective one of said terminals, said pair of internal contact plates are adapted for movement relative one another, each of said pair of internal contact plates including an electromagnet section, the electromagnet sections being operative to produce a polarity in the electromagnet section on one contact plate opposite the polarity of the electromagnet section on the other contact plate whereby energizing the electromagnet sections causes the pair of contact plates to move toward one another;

(b) an intermediate contact layer having a plurality of individually insulated, similarly low resistance, wire elements oriented parallel to one another and extending between first and second sides of said intermediate contact layer, the plurality of discrete wire elements being sufficient in number to allow for a flow of electricity between the pair of contact plates through each of the plurality of discrete wire elements when the internal contact plates are moved toward each other for contacting the first and second sides of the intermediate contact layer, the flow of electricity being of a magnitude insufficient to produce a harmful arc whereby when the switch is opened, a first side of said intermediate layer contacting one of the contact plates and a second side of said intermediate layer contacting the other of said contact plates to allow a flow of electricity between the pair of contact plates through each of the plurality of insulated wire elements of a magnitude insufficient to produce a harmful arc, and when the switch is opened the flow of electricity through each of the wire elements is substantially simultaneously interrupted, said intermediate contact layer including an intermediate electromagnet section operative to be energized so as to produce in a first portion disposed on said first side of the intermediate layer having a polarity like the polarity of the contact plate proximate the first side and a second portion disposed on said second side of the intermediate layer having a polarity opposite the polarity of the first portion and like the polarity of the contact plate proximate the second side whereby energizing the electromagnet section of the intermediate layer at the same time that the electromagnet sections of said contact plates are energized causes the pair of contact plates to move apart from one another to interrupt the flow of electricity between the pair of contact plates through the plurality of discrete conductors of the intermediate contact layer; and (c) an electric circuit operative to simultaneously energize the electromagnet sections of both contact plates and having:

(i) a dc subcircuit;

(ii) a first solid state switch connected between said dc subcircuit and a first ac power source so as to be latched on by activation of said subcircuit;

(iii) relay switch means for activating the electromagnet sections of the contact plates when the solid state switch conducts;

(iv) a sensor element disposed for activation by the flow of electricity through said contact plates; and (v) a sensor circuit disposed between the sensor element and the first solid state switch so that the first solid state switch is latched open in response to activation of the sensor element.

12. The switch of claim 11, wherein said electric circuit further includes:

a second solid state switch connected to said intermediate electromagnet section, a second sensor element disposed so that the flow of electricity through said contact plates induces a current in said sensor element;

a second sensor circuit disposed between said second solid state switch and said second sensor element so that said second solid state switch is latched off by the current in said sensor element; and a manual switch electrically connected between said second sensor circuit and said second solid state switch operative upon closing to provide a current to said second solid state switch so as to latch on said second solid state switch and energize said intermediate electromagnet section.

13. The switch of claim 11, wherein said contact plates are formed from a plurality of discrete conductors.

14. The switch of claim 11, wherein said plurality of insulated wire elements are oriented into a bundle having uniform planar opposed end surfaces positioned on said first and second sides of said intermediate contact layer to contact the pair of contact plates.

15. The switch of claim 11, wherein said plurality of insulated wire elements are oriented into a plurality of bundles, each bundle having uniform planar opposed end surfaces positioned on said first and second sides of said intermediate contact layer respectively to contact the pair of contact plates.

16. The switch of claim 12, wherein said electric circuit further includes threshold circuit means electrically connected between said second sensor circuit and said second solid state switch so as to latch on said second solid state switch and energize said intermediate electromagnet section when the current through said contact plates exceeds a predetermined current.

17. The switch of claim 11, wherein the first solid state switch comprises a first triac.

18. The switch of claim 11, wherein the relay switch means comprises an electromagnetic switch.

19. The switch of claim 11, wherein the sensor element comprises a pickup coil and the sensor circuit comprises a bridge diode.

20. The switch of claim 16, wherein the threshold circuit means comprises a zener diode and a resistor.

* * * * *